US005716498A

United States Patent [19]

Jenny et al.

[11] Patent Number: 5,716,498

[45] Date of Patent: Feb. 10, 1998

[54] PROCESS FOR SOFTENING PAPER IN MANUFACTURE

[75] Inventors: Neil A. Jenny, Lake Geneva, Wis.; William J. Zeman, Janesville, Ill.

[73] Assignee: Witco Corporation, Greenwich, Conn.

[21] Appl. No.: 631,240

[22] Filed: Apr. 12, 1996

[51] Int. Cl.[6] ..... D21H 21/22; D21H 17/07; D21H 11/14

[52] U.S. Cl. ..... 162/158; 162/179; 162/111

[58] Field of Search ..... 162/179, 158, 162/111, 164.6, 166, 168.1, 168.2, 164.7

[56] References Cited

U.S. PATENT DOCUMENTS

| | | | |
|---|---|---|---|
| 3,427,219 | 2/1969 | Bonzagni | 162/179 |
| 4,351,699 | 9/1982 | Osborn, III | 162/112 |
| 4,425,186 | 1/1984 | May et al. | 162/158 |
| 4,786,367 | 11/1988 | Bogart et al. | 162/158 |
| 5,262,007 | 11/1993 | Phan et al. | 162/158 |
| 5,264,082 | 11/1993 | Phan et al. | 162/158 |
| 5,415,737 | 5/1995 | Phan et al. | 162/111 |
| 5,437,766 | 8/1995 | Van Phan et al. | 162/127 |
| 5,538,595 | 7/1996 | Trokhan et al. | 162/123 |
| 5,543,067 | 8/1996 | Phan et al. | 106/287.5 |
| 5,552,020 | 9/1996 | Smith et al. | 162/164.4 |

FOREIGN PATENT DOCUMENTS 43 34 367 4/1995 Germany .

*Primary Examiner*—Donald E. Czaja
*Assistant Examiner*—José S. Fortuna
*Attorney, Agent, or Firm*—Scully, Scott, Murphy & Presser

[57] ABSTRACT

Paper having a improved softness is obtained by adding to the fiber suspension from which the paper is made, a quaternized fatty acid trialkanolamine ester salt of the formula (I)

$$[R^1CO-(OCH_2CH_2)_mOCH_2CH_2-\underset{\underset{(ALK)-O(CH_2CH_2O)_pR^3}{|}}{\overset{\overset{R^4}{|}}{N}}-CH_2CH_2O-(CH_2CH_2O)_nR^2]X^- \quad (I)$$

in which $R^1CO$ represents an acyl radical having 6 to 22 carbon atoms, $R^2$ and $R^3$, independently of one another, represent hydrogen or $R^1CO$, (ALK) is ethyl or propyl, $R^4$ represents an alkyl radical having 1 to 4 carbon atoms or a $(CH_2CH_2O)_qH$ group, the sum of m, n and p represents O or numbers from 1 to 12, q represents numbers from 1 to 12 and X represents halide, alkylsulfate or alkylphosphate.

7 Claims, No Drawings

PROCESS FOR SOFTENING PAPER IN MANUFACTURE

FIELD OF THE INVENTION

The invention relates to a process for the production of commercial papers having an improved soft feel, and enhanced bulk, in which quaternized fatty acid triethanolamine ester salts are used as softeners and debonders, and the use of these substances as auxiliary substances in paper production.

BACKGROUND OF THE INVENTION

The general term "paper" is understood as meaning any of about 3000 different grades and articles, some of which may differ considerably in their fields of use and their quality. A number of additives are required for their production, of which fillers (for example chalk or kaolin) and binders (for example starch) are among the most important. For the area of tissue, toweling, napkins, and hygiene papers which are brought into close contact with the human skin, but, for example, also for heavy typewriter paper, there is a particular need for a pleasant soft feel, which is usually imparted to the paper by careful selection of the fibers and in particular a high proportion of fresh groundwood or cellulose. With regard to the cost-efficiency of paper production and from the ecological point of view, however, it is desirable concomitantly to use as high proportions as possible of lower-quality recycled paper. However, this results in a significant deterioration in the soft feel of the paper.

It is accordingly desirable to find a process with the aid of which commercial paper, in particular tissue paper, having a pleasant soft feel can be produced even when made from raw materials which contain a high proportion of recycled paper. At this time, it was desirable to meet this objective with relatively biodegradable compounds.

SUMMARY OF THE INVENTION

The invention relates to a process for the production of paper having an improved soft feel, and enhanced bulk, comprising making the paper from an aqueous suspension of fibers wherein the suspension comprises a quaternized fatty acid trialkanolamine ester salt component selected from the group consisting of compounds of the formula (I)

$$[R^1CO-(OCH_2CH_2)_mOCH_2CH_2-\underset{\substack{|\\(ALK)-O(CH_2CH_2O)_pR^3}}{\overset{\substack{R^4\\|}}{N}}-CH_2CH_2O-(CH_2CH_2O)_nR^2]X^- \quad (I)$$

and mixtures thereof, in which $R^1CO$ represents an acyl radical having 6 to 22 carbon atoms, $R^2$ and $R^3$, independently of one another, represent hydrogen or $R^1CO$, (ALK) is ethyl or propyl (i.e. n-propyl or preferably isopropyl), $R^4$ represents an alkyl radical having 1 to 4 carbon atoms or a $(CH_2CH_2O)_qH$ group, each of m, n and p represents O or a number from 1 to 12, q represents 1 to 12 and X represents halide, alkylsulfate or alkylphosphate, as a softener for the paper thereby produced.

Surprisingly, it was found that quaternized fatty acid trialkanolamine ester salts are suitable for imparting a pleasant soft feel even to particularly critical tissue paper containing up to 95% by weight of recycled (waste) paper. The invention furthermore includes the discovery that the salts improve the adhesion of the moist paper webs to the press rolls, so that operating faults due to folding can be readily avoided. Furthermore, another advantage is that the quaternized salts are ecotoxicologically safe and in particular can be readily biodegraded.

DETAILED DESCRIPTION OF THE INVENTION

Quaternized fatty acid trialkanolamine ester salts, which are also usually referred to as "esterquats" for short, are known substances which can be obtained by the relevant methods of preparative organic chemistry.

In this context, reference may be made to International Patent Application WO 90/01 295 (Henkel), according to which triethanolamine is partially esterified with fatty acids in the presence of hypophosphorous acid, air is passed through and quaternization is then effected with dimethyl sulfate or ethylene oxide. The use of esterquats as reviving agents for textiles has been described, for example, in the review articles by O. Ponsati in C. R. CKD Congress, Barcelona, 167 (1992) and R. Punchta in C. R. CED Congress, Sitges, 59 (1993).

Typical examples of esterquats which can be used for the purposes according to the invention are products based on caproic acid, caprylic acid, capric acid, lauric acid, myristic acid, palmitic acid, isostearic acid, stearic acid, oleic acid, elaidic acid, arachidic acid, behenic acid, and erucic acid and industrial mixtures thereof, as obtained, for example, in the cleavage of natural fats and oils under pressure. It will be recognized that fatty acids derived from naturally occurring sources will have a mixture of chain lengths and degrees of saturation and unsaturation.

Examples of such sources include coconut fatty acids, tallow fatty acids including partially hydrogenated tallow and hardened tallow, palm oil acids, and fatty acids derived from canola oil or from partially hydrogenated canola oil.

The fatty acids and the triethanolamine can be used in a molar ratio of from 1.1:1 to 3:1 for the preparation of the quaternized esters. With regard to the performance characteristics of the esterquats, a ratio of from 1.2:1 to 2.2:1, preferably from 1.5:1 to 1.9:1, has proven particularly advantageous for use. The preferred esterquats are industrial mixtures of mono-, di- and triesters having an average degree of esterification of from 1.5 to 1.9 and are derived from industrial $C_{16/18}$ tallow or palm oil acid (iodine number from 0 to 40). Esterquats which are monoacyl, diacyl or triacyl products wherein the acyl portion is oleyl, are preferred, especially the dioleyl derivatives.

Quaternized fatty acid trialkanolamine ester salts of the formula (I), in which $R^1CO$ represents an acyl radical having 16 to 18 carbon atoms, $R^2$ represents $R^1CO$, $R^3$ represents hydrogen, $R^4$ represents a methyl group, (ALK) represents ethyl or particularly isopropyl, m, n and p represent O and X represents methyl-sulfate, have proven particularly advantageous for improving the soft feel of commercial paper, in particular tissue papers.

The esterquats are usually commercially available in the form of from 50 to 90% strength by weight solutions in water or water plus lower alkanol preferably $C_2$–$C_4$ alkanol, most preferably isopropanol. If required, the solution can be readily diluted with water.

A wide range of different materials are suitable for the purposes of the invention as starting materials for the production of commercial paper. Mechanical pulps, such as, for example, groundwood, are one possible starting material. These are generally produced in an integrated production process in the paper mill, usually in the form of a pumpable slurry which in turn can comprise the aqueous suspension of fibers from which the paper is made—and to which the esterquat of formula (I) is added.

The aqueous suspension of fibers is obtained by any of the numerous known processes, beginning from pulp of virgin pulpwood, from recycled paper and/or cardboard stock, or mixtures thereof. The pulp is subjected to treatment by any of several conventional processes, to help the establishment of a suspension of fibers sufficiently finely dispersed to constitute an acceptable suspension processable into paper. Thus, the pulp can be treated for instance mechanically, chemically, or both, often with the application of heat, to convert it to a processable suspension. Several chemical processes such as the Kraft process are well-known in this field. Recycled paper is another possible starting material. It is usually first freed from impurities, sorted, comminuted, dispersed in water and freed from printing inks and fillers, such as, for example, inks, by flotation ("deinking"). Aqueous fiber suspensions which contain from 50 to 95% by weight of deinked waste paper can preferably be used.

The fibers as that term is used herein include any of a chemical constituency and physical form which can be formed into an aqueous suspension which can in turn be produced into paper. Generally the fibers are predominantly cellulosic but may also contain lignins, hemi-cellulosics, and other fibrous components derived from synthetic polymers, cloth, and the like.

The aqueous suspension of fibers can optionally contain any of numerous conventional additives such as sizing, pigments, wet strength resins, dry strength additives, fillers and opacifiers, defoamers, and the like, present in the amount appropriate for achieving the desired function of each such component that is used. The esterquats advantageously alleviate the harshness which such additives can impart to the paper.

The aqueous suspension of fibers is then formed into a flat sheet, usually by means of a machine specially adapted for this function. At this point the suspension generally has a solids content of from 3 to 5%, preferably from 3.5 to 4%, by weight, which is advantageously diluted to a concentration below 0.5%, preferably to 0.1 to 0.2%, by weight. Preferably, a Fourdrinier or equivalent machine presenting a wide, flat, porous screen (which preferably moves at a predetermined rate) has at one end a means such as a headbox which contains the aqueous dispersion of fibers and which feeds the dispersion at a controlled rate onto one end of the screen.

The quaternized fatty acid trialkanolamine ester salt component may be added to the aqueous fiber suspension directly to the pulp or after dilution, or both, in amounts of from 0.5 to 10, preferably from 1 to 4, kg/t—salts calculated as solids—it being necessary to ensure intensive homogenization, for example by means of a stirrer or a static mixer. It can be added into feed lines, or onto the horizontal sheet. Suitable further auxiliary substances are, for example, fillers (for example kaolin, chalk, titanium dioxide) for improving the smoothness, dyes and pigments for coloring the paper pulp, binders (for example proteins, plastics dispersions, resin glues) for consolidating the fiber structure and optical brighteners (for example stilbene dyes) for increasing the whiteness.

An extensive web is then produced continuously from the highly diluted suspension in the head box and said web is fed by means of a conveyor belt ("wire part"), a plurality of rolls ("press section"), steam-heated drying cylinders ("drying section"), cooling cylinders and a smoothing machine to the reel. The web width may be from 0.5 to 10, preferably from 1 to 5 meters and the web speed may be from 500 to 2000, preferably from 1000 to 1500, meters per second.

The wire part usually consists of a continuous belt which consists of fine-meshed plastic fabric in which various drainage elements are incorporated. At the end of the wire part, the paper web still contains about 80% by weight of water but is already sufficiently solid to be removed from the wire by pick-up felts or reduced pressure. In the subsequent press section, the paper web is compacted by mechanical pressure and further drained; in this procedure, it is passed by means of a continuous guided felt cloth between a plurality of smaller rolls and one large roll ("Yankee dryer") of steel, granite or hard rubber and drained to a residual moisture content of about 50% by weight. The amounts of water separated off in the wire part and press section can be purified and then recycled to the process. In the subsequent drying section, the paper web is passed around up to 100 steam-heated drying cylinders and cooled with the aid of a cooling cylinder from 70°–80° C. to 20°–30° C.; the residual moisture content is usually from 5 to 85 by weight.

By adding quaternized fatty acid triethanolamine ester salt component as defined herein, it is possible to produce commercial paper (in particular toweling, napkins, facial and toilet tissue paper) having a satisfactory soft feel, even when the starting material used is a solid suspension which has a recycled paper content of up to 95% by weight. Commercial paper is to be understood as meaning paper which has a weight of from 10 to 400 and preferably from 15 to 150 g/m$^2$. Typically examples are bank note paper, bank post paper, baryta paper, bible paper, mold-made paper, colored paper, chrono paper, document paper, printing paper, light-weight paper, electrical insulating paper, filter paper, blotting paper, wood-containing paper, hygiene paper, Japanese parchment paper, capacitor paper, Kraft paper, crepe paper, light-weight coated paper, oiled paper, overlay paper, wrapping paper, papermachè, parchment paper, glassine, photographic paper, recycled paper, writing paper, tissue paper, synthetic paper, wallpaper base and newsprint.

The esterquats of formula (I) are preferably used as softeners in the production of tissue paper, which usually has a weight of from 10 to 40, preferably from 15 to 25, grams per square meter.

Accordingly, the invention furthermore relates to the method which comprises adding a quaternized fatty acid trialkanolamine ester salt of the formula (I)

$$[R^1CO-(OCH_2CH_2)_mOCH_2CH_2-\underset{\underset{(ALK)-O(CH_2CH_2O)_pR^3}{|}}{\overset{\overset{R^4}{|}}{N}}-CH_2CH_2O-(CH_2CH_2O)_nR^2]X^- \quad (I)$$

in which $R^1CO$ represents an acyl radical having 6 to 22 carbon atoms, $R^2$ and $R^3$, independently of one another, represent hydrogen or $R^1CO$ (ALK) is ethyl, n-propyl or isopropyl, $R^4$ represents an alkyl radical having 1 to 4 carbon atoms or a $(CH_2CH_2O)_qH$ group, the sum of m, n and p represents O or numbers from 1 to 12, q represents numbers from 1 to 12 and X represents halide, alkylsulfate or alkylphosphate, to the aqueous fiber suspension which is then screened, dried and rolled in any conventional manner employed in paper production.

What is claimed is:

1. A process for the production of commercial paper having an improved soft feel and increased bulk, comprising forming an aqueous suspension of fibers, forming the suspension into a flat sheet, and drying the sheet, wherein said suspension comprises a quaternized fatty acid trialkanolamine ester salt component selected from the group consisting of compounds of formula (I)

$$(R^1CO-(OCH_2CH_2)_mOCH_2CH_2-\underset{\underset{(ALK)-O(CH_2CH_2O)_pR^3}{|}}{\overset{\overset{R^4}{|}}{N}}-CH_2CH_2O-(CH_2CH_2O)_nR^2)X^- \quad (I)$$

and mixtures thereof, in which $R^1CO$ represents an acyl radical having 6 to 22 carbon atoms, $R^2$ and $R^3$, independently of one another, represent hydrogen or $R^1CO$, (ALK) represents ethyl, n-propyl or isopropyl, $R^4$ represents an alkyl radical having 1 to 4 carbon atoms or a $(CH_2CH_2O)_qH$ group, the sum of m, n, and p represents 0 or numbers from 1 to 12, q represents numbers from 1 to 12 and X represents halide, alkylsulfate or alkylphosphate.

2. A process according to claim 1, wherein $R^1CO$ represents an acyl radical having 16 to 18 carbon atoms, $R^2$ represents $R^1CO$, $R^3$ represents hydrogen, (ALK) represents isopropyl, $R^4$ represents a methyl group, m, n and p represent O and X represents methylsulfate.

3. A process according to claim 1 wherein the aqueous fiber suspension has a solids content of from 0.1 to 5% by weight.

4. A process according to claim 2 wherein the aqueous fiber suspension has a solids content of from 0.1 to 5% by weight.

5. A process according to claim 1 wherein said quaternized fatty acid trialkanolamine ester salt component comprises from 0.5 to 10 kg, dry basis, per ton of said suspension.

6. A process according to claim 2 wherein said quaternized fatty acid trialkanolamine ester salt component comprises from 0.5 to 10 kg, dry basis, per ton of said suspension.

7. A process for the production of commercial paper having an improved soft feel and increased bulk, comprising forming an aqueous suspension of fibers, forming the suspension into a flat sheet, and drying the sheet, wherein said suspension comprises a quaternized fatty acid trialkanolamine ester salt component selected from the group consisting of compounds of formula (I)

$$(R^1CO-(OCH_2CH_2)_mOCH_2CH_2-\underset{\underset{(ALK)-O(CH_2CH_2O)_pR^3}{|}}{\overset{\overset{R^4}{|}}{N}}-CH_2CH_2O-(CH_2CH_2O)_nR^2)X^- \quad (I)$$

and mixtures thereof, in which $R^1CO$ represents an acyl radical having 16–22 carbon atoms, $R^2$ and $R^3$, independently of one another, represent hydrogen or $R^1CO$, (ALK) represents ethyl, n-propyl or isopropyl, $R^4$ represents an alkyl radical having 1 to 4 carbon atoms or a $(CH_2CH_2O)_qH$ group, the sum of m, n, and p represents 0 or numbers from 1 to 12, q represents numbers from 1 to 12 and X represents halide, alkylsulfate or alkylphosphate.

* * * * *